United States Patent [19]

Ober et al.

[11] Patent Number: 4,652,508

[45] **Date of Patent: * Mar. 24, 1987**

[54] TONER COMPOSITIONS WITH STABILIZER IRREVERSIBLY ANCHORED THERETO

[75] Inventors: Christopher K. Ober, Oakville; Kar P. Lok, Mississauga, both of Canada

[73] Assignee: Xerox Corporation, Stamford, Conn.

[ * ] Notice: The portion of the term of this patent subsequent to Jun. 18, 2002 has been disclaimed.

[21] Appl. No.: 722,100

[22] Filed: Apr. 11, 1985

[51] Int. Cl.[4] ..... G03G 9/00; G03G 9/08

[52] U.S. Cl. ..... 430/109; 430/110; 430/120

[58] Field of Search ..... 430/109, 110, 120

[56] References Cited

U.S. PATENT DOCUMENTS

| | | | |
|---|---|---|---|
| 3,591,537 | 7/1971 | Squire et al. | 260/17 |
| 3,767,603 | 10/1973 | Kayanagi et al. | 260/17 A |
| 3,770,692 | 11/1973 | Miller | 260/41 C |
| 3,852,208 | 12/1974 | Nagashima et al. | 430/109 |
| 3,933,664 | 1/1976 | Nagashima et al. | 430/109 X |
| 3,941,729 | 3/1976 | Klein | 260/17 A |
| 3,959,153 | 5/1976 | Sadamatsu et al. | 252/62.1 P |
| 3,965,021 | 6/1976 | Clemens et al. | 430/109 |
| 4,077,804 | 3/1978 | Vanzo | 96/1 SD |
| 4,107,062 | 8/1978 | Tomono et al. | 430/109 |
| 4,134,760 | 1/1979 | Gibson et al. | 96/1 SD |
| 4,152,279 | 5/1979 | Mincer et al. | 252/62.1 P |
| 4,282,304 | 8/1981 | Bayley | 430/137 |
| 4,299,903 | 11/1981 | AuClair et al. | 430/137 |
| 4,448,871 | 5/1984 | Tamaki et al. | 430/109 |
| 4,476,210 | 10/1984 | Croucher et al. | 430/137 |
| 4,524,199 | 6/1985 | Lok et al. | 526/909 X |

FOREIGN PATENT DOCUMENTS

| | | | |
|---|---|---|---|
| 0010986 | 5/1980 | European Pat. Off. . | |
| 0139750 | 8/1982 | Japan | 430/109 |
| 7168254 | 10/1982 | Japan . | |
| 0107549 | 6/1983 | Japan | 430/109 |
| 0177570 | 10/1984 | Japan | 430/109 |
| 0195662 | 11/1984 | Japan | 430/109 |
| 0228660 | 12/1984 | Japan | 430/109 |

OTHER PUBLICATIONS

"Kinetics of Polymerization in Dispersed Systems", Levy et al., Impac Macro, 1982, p. 76.

"Monodisperse Polymeric Spheres in the Micron Size Range by a Single Step Process, Almog et al., The British Polymer Journal, Dec. 1982, pp. 131–136.

"Polyelectrolyte Stabilised Latices Part 1, Preparation", Corner, Elsevier Scientific Publishing Company, 1981, pp. 119–129.

"Absorption of Low Molecular Weight Compounds in Aqueous Dispersions by Polymer–Oligmer Particles" 2[a], Makromol Chem. 180, 1979, pp. 737–744.

*Primary Examiner*—John E. Kittle
*Assistant Examiner*—Mukund J. Shah
*Attorney, Agent, or Firm*—E. O. Palazzo

[57] ABSTRACT

Disclosed is an improved toner composition comprised of colored dyes and resin particles, having irreversibly anchored thereto stabilizer generated by the reaction of a stabilizer selected from the group consisting of hydroxy celluloses, poly(acrylic acids), poly(vinyl butyral), and poly(vinyl pyridines), with an alkyl halide, an alcohol, or a carboxylic acid.

28 Claims, No Drawings

TONER COMPOSITIONS WITH STABILIZER IRREVERSIBLY ANCHORED THERETO

BACKGROUND OF THE INVENTION

This invention is generally directed to processes for affecting the preparation of toner compositions, and more specifically the present invention is directed to toner compositions of a negative, or positive polarity generated from a dispersion polymerization process wherein the stabilizers present are chemically transformed by reaction with, for example, alkyl halides, enabling the charge polarity desired. In one embodiment thus the present invention is directed to toner compositions prepared from a dispersion polymerization process, wherein the stabilizers selected, inclusive of hydroxypropyl cellulose, are reacted with alkyl halides for the purpose of transforming the surface sites into salts thereby allowing a permanent charge of either a positive or negative polarity. The resulting transformed stabilizers are, therefore, functioning similar to known charge enhancing additives. Also, the toner compositions of the present invention are useful for permitting the development of images in electrostatic imaging processes wherein the members selected can be positively or negatively charged.

The development of images, and in particular electrostatic images with toner compositions, is well known. In many of these processes, an electrostatic latent image is formed on a photoconductor member, and the image is developed with a toner composition comprised of resin particles and carbon black. Subsequently, the developed image is transferred to a suitable substrate wherein fixing is accomplished by heat. Accordingly, final copies of the toner image are produced by heating the toner to a temperature at which it begings to flow enabling fusing of the particles to a support substrate such as paper. Various suitable toner and developer compositions can be used in these processes. Further, there has been disclosed positively charged toners with charge enhancing additives, reference for example U.S. Pat. No. 3,893,935, enabling their use in imaging processes wherein the photoconductive member is negatively charged.

There is also described in U.S. Pat. No. 2,986,521 reversal developer compositions comprised of toner resin particles coated with finely divided colloidal silica. According to the disclosure of this patent the development of electrostatic atent images on negatively charged surfaces is accomplished by applying a developer composition having a positively charged triboelectric relationship with respect to the colloidal silica. Furthermore, there is disclosed in U.S. Pat. No. 4,338,390 positively charged developer and toner compositions having incorporated therein as charge enhancing additives organic sulfate and sulfonate compositions. Moreover, disclosed in U.S. Pat. No. 4,298,672 are positively charged toner compositions with resin particles and pigment particles, and as a charge enhancing additive allkyl pyridinium compounds and their hydrates.

Other patents disclosing toner compositions with charge control additives include U.S. Pat. Nos. 3,944,493; 4,007,293; 4,079,014; and 4,394,430.

Dispersion polymerization processes for obtaining toner compositions are also known. There is thus disclosed in U.S. Pat. No. 4,282,304 a dispersion polymerization method wherein magnetic particles are first mixed with a monomer and an initiator. Subsequently, this mixture is suspended in an aqueous medium wherein a reaction occurs within each particle. The use of stabilizing compounds, inclusive of methylhydroxy propylcellulose, are disclosed in this patent; however, these stabilizers have not been modified by treatment with, for example alkyl halides, an important feature of the process of the present invention.

Further, in copending application U.S. Pat. No. 4,524,199, entitled Stable Polymeric Dispersion and Methods for Making, the disclosure of which is totally incorporated herein by reference, there is described a stable polar dispersion with nonionic amphipathic steric stabilizers irreverisbly anchored to a momomer. Stabilizers disclosed in this application include grafted cellulose compounds.

While the above toner compositions are suitable for their intended purposes, there is a need for improved toner compositions, particularly dry toner compositions for use in imaging systems wherein the surface stabilizers selected are subjected to a chemical treatment. More specifically, there remains a need for toner compositions prepared by a dispersion polymerization process wherein there can be obtained compositions of a positive polarity or a negative polarity by the chemical transformation of the stabilizer surface. Moreover, there continues to be a need for improved positively charged or negatively charged toner compositions, which can be prepared in a simple and economical manner, and wherein the resulting charge enhancing additive moiety is retained, and not leached from the toner as is the situation with several prior art charge enhancing additives. Furthermore, there continues to be a need for toner compositions wherein the charge enhancing additive function is assumed by modified stabilizer compounds selected for the dispersion polymerization process. Also, there is a need for processes that affect the simple chemical transformation of the surface of stabilizer compounds by reactions with alkyl halides, organic carboxylic acids, and organic alcohols, especially aliphatic alcohols, enabling the selection of the charge polarity for the resulting toner compositions prior to the preparation thereof. Additionally, there is a need for toner compositions with desirable admix charging properties, and appropriate triboelectric values, permitting these compositions to be highly useful in xerographic imaging methods.

SUMMARY OF THE INVENTION

It is an object of the present invention to provide toner compositions which overcome several of the above noted disadvantages.

A further object of the present invention resides in the provision of dispersion polymerization processes wherein the stabilizers selected are modified by treatment with various reactants.

In an additional object of the present invention there are provided dispersion polymerization processes that enable in a direct and simple manner positively charged, or negatively charged toner compositions.

In yet an additional object of the present invention there are provided dispersion processes wherein the stabilizers selected are chemically transformed causing the surface thereof to function as charge enhancing additive sites.

A further object of the present invention resides in the provision of toner dispersion processes wherein the stabilizers selected are chemically transformed by alkyl halides, carboxylic acids, and aliphatic alcohols causing the surface thereof to function as charge enhancing additive sites.

An additional object of the present invention resides in the provision of dispersion processes wherein the resulting dry toner compositions can be selected for use in developing positively charged or negatively charged images in electrostatic imaging processes.

In a further object of the present invention there is provided a process for affecting the chemical transformation of stabilizers selected for toner dispersion polymerization processes.

A further object of the present invention resides in the postpolymerization transformation of stabilizers to form materials which are suitable for polymerization.

These and other objects of the present invention are accomplished by the provision of toner compositions, and dispersion polymerization processes thereof, wherein the stabilizers selected are chemically treated. More specifically, in one embodiment there is provided in accordance with the present invention polymer compositions prepared by a dispersion polymerization process which comprises providing a solvent medium having dissolved therein a monomer, and a steric stablizer affecting polymerization thereof resulting in, for example, monodispersed particles comprised of a thermoplastic resin which is substantially insoluble in the solvent medium, and irreversibly anchored thereto the stabilizers, and subsequently transforming the surface of the stablizer by reaction with compositions selected from the group consisting of alkyl halides, carboxylic acids, and aliphatic alcohols. Thereafter, colored toner particles can be generated by diffusing an oil soluble dye in the product obtained from the aforementioned process.

In one specific important embodiment of the present invention there is provided polymer compositions prepared by a dispersion polymerization process which comprises providing a solvent medium having dissolved therein a monomer, and a steric stabilizer affecting polymerization thereof resulting in, for example, monodispersed particles comprised of a polymer which is substantially insoluble in the dispersion medium, and irreversibly anchored thereto stabilizers, selected from the group consisting of hydroxy cellulose, poly(acrylic acids), poly(vinyl butyral), and poly(vinyl pyridines); and subsequently transforming the surface of the stabilizer by reaction with compositions selected from the group consisting of alkyl halides, carboxylic acids, and aliphatic alcohols, enabling positively charged, or negatively charged polymer compositions depending on the stabilizer selected. Thereafter, colored toner particles of a positive or negative polarity can be generated with the diffusion of an oil soluble dye in the product obtained from the aforementioned process.

Chemical transformation of the stabilizers selected is accomplished by the reaction thereof with those compounds that will enable the formation of a charge enhancing moiety, or that will provide a modified surface permitting a positively charged or negatively charged toner to be formed. Generally, this tranformation in one embodiment of the present invention is generated by the mixing of monomer particles in an amount of from about 5 percent by weight to about 50 percent by weight in a dispersing medium including aliphatic alcohols, which particles contain on the surface thereof a tertiary amine stabilizer, such as poly(vinylpyridine). Thereafter, and subsequent to polymerization, this mixture is reacted with an alkyl halide, at a temperature of from about 20 to about 80 degress Centigrade. The reaction time can vary depending on the amount of reactants selected, for example, however usually the transformation is completed in from about 1 to about 24 hours when the reaction mixture is contained in an anhydrous solvent that will not dissolve the monomer particles. There results, as determined by observing changes in the triboelectric properties of the product produced, a transformation of the tertiary amine stabilizer to a quaternary ammonium salt enabling polymer particles with a triboelectric charge thereon of from about a positive 5 to a positive 50 microcoulombs per gram result. Toner compositions of a triboelectric charge of from about a positive 5 to a positive 50 microcoulombs per gram are obtained by the mixing of the polymer particles with the transformed stabilizer irreversibly anchored thereto, and an oil soluble dye as indicated herein.

Other transformations with carboxylic acids, and aliphatic alcohols are accomplished in a similar manner. Specifically thus, transformation can be generated by the mixing of monomer particles with a poly(acrylic acid) stabilizer anchored thereto, in an amount of from about 1 percent by weight to about 50 percent by weight, in about 1,000 milliliters of an aliphatic alcohol, dispersing medium such as methanol. Subsequently, and after polymerization, this mixture is reacted with an akyl alcohol at a temperature of from about 30 to about 85 degrees Centigrade. While the aforementioned transformation reaction time can vary, it usually is completed in about 24 hours. Also, there can be added to the dispersion mixture prior to the transformation an effective amount, about 0.1 percent by weight of a catalyst such as p-toluene sulfonic acid enabling an increase in the rate of transformation. There thus results polymer particles with a transformed stabilizer on the surface thereof which is a mixture of acid and ester sites. A negative triboelectric charge value is derivable from the acid sites, and further the magnitude of this charge can be adjusted by decreasing the number of acid sites. Generally, the triboelectric charge is a −5 microcoulombs per gram to −50 microcoulombs per gram when all acid sites are present. In contrast, when converting all the acid sites to ester sites the triboelectric charge is a +5 microcoulombs per gram to +50 microcoulombs per gram.

In a similar manner, polymer particles with a stabilizer on the surface thereof containing alcohol or hydroxy functions like poly(vinylbutyral) and hydroxy celluloses can be transformed with a carboxylic acid, such as acetic acid, at a temperature of from about 30 to about 70 degrees Centigrade. The stabilizer in this embodiment is thus transformed to a mixture of hydroxy and ester sites. The aforementioned ester sites control the positive triboelectric charge of the toner particles. Additionally, by converting all the hydroxy sites to ester groups the magnitude of the positive triboelectric charge can be decreased.

The stabilizer is present in the final toner product in an amount of from about 0.1 percent to about 1.0 percent by weight, and preferably in an amount of from about 0.5 percent to about 1.0 percent by weight. In this manner, there results on the toner a positive or negative triboelectric charge of from a plus or minus 5 microcoulombs per gram to a plus or minus 50 microcoulombs per gram.

Specific examples of stabilizers that can be transformed in accordance with the present invention include hydroxyethyl cellulose, hydroxypropyl cellulose, hydroxybutyl cellulose, hydroxybutyl methyl cellulose, hydroxypropyl methyl cellulose, ethyl cellulose, polymeric acids such as poly(acrylic acid), polymethacrylic acid and their corresponding copolymers; copolymers of poly(maleic acid); and polymeric amines inclusive of poly(vinylpyrdines).

Illustrative examples of alkyl halide reactants suitable for transformation of the tertiary amines stabilizers such as poly(vinylpyridines) include methyl chloride, ethyl chloride, propyl chloride, butyl chloride, methyl bromide, benzyl chloride, cetyl chloride, cetyl bromide, and the like. Other alkyl halide can be selected wherein the alkyl substituent contains from about 1 carbon atoms to about 20 carbon atoms, and the halide is chloride, bromide, iodide, or fluoride, providing the objectives of the present invention are achieved. These halides, 0.1 moles to about 10 moles per mole of stabilizer, are reacted with the stabilizer by heating to from about 20 to 80 degrees Centigrade.

Specific examples of alcohol reactants in amounts of about 0.1 moles to 10 moles per mole of stabilizer suitable for transformation of the poly(acrylic acids) stabilizers are methanol, ethanol, isopropanol, n-propanol, butanol, cellosolve, methyl cellosolve, benzyl alcohol, substituted benzyl alcohols, and the like. Specific carboxylic reactant stabilizer examples are acetic acid, propionic acid, benzoic acid, butoxy benzoic acid, substituted alkyl acids, or mixtures thereof, Similar transformations can be affected with carboxylic acids when the stabilizers are poly(vinylbutyral) or hydroxy celluloses.

Illustative examples of suitable monomers having incorporated therein the chemically transformed stabilizers illustrated herein subsequent to polymerization and selected for the toner and developer compositions of the present invention include vinyl monomers. Typical vinyl monomeric units include: styrene, p-chlorostyrene, and vinyl naphthalene; vinyl halides such as vinyl chloride, vinyl bromide, vinyl fluoride, vinyl acetate, vinyl propionate, vinyl benzoate, vinyl butyrate and the like; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidone and the like; mixtures of styrene butadiene monomers; and mixtures thereof.

The polymerized polymer resin particles are present in a sufficient, but effective amount, thus when about 1 percent by weight of the stabilizer composition and 5 percent by weight of diffused color dye is present, about 94 percent by weight of polymer material is selected. Generally, from about 0.1 to about 1 percent by weight of the stabilizer composition, about 0.5 to about 20 percent by weight of colored diffused dye, and about 80 to about 99 percent by weight of polymer material is present.

Colored toner compositions are prepared by diffusing into the polymer mixture with transformed stabilizer thereon a dye solution comprised of an organic solvent and various known dyes inclusive of red, blue, yellow, cyan, magenta, or mixture thereof. Specific examples of dyes selected are Oil Blue A, Passaic Oil Green, Sudan Red, Sudan Yellow 146, DuPont Oil Blue A, Passaic Oil Red 2144, Oil Yellow, Sudan Red 7B, Oil Pink 312, Pylachrome Pink LX1900, Sudan Black B, Ceres Blue R, Sudan Deep Black, Ceres Black BN, a dye mixture containing the cyan Savinyl Blue GLS, the magenta Sudan Red 460, and the yellow dye Sudan Yellow 146. The dye is present in the organic solvent in an amount of from about 1 percent by weight to about 50 percent by weight; and preferably in an amount of from about 15 percent by weight to about 25 percent by weight.

Examples of organic solvents that can be selected for the process of the present invention include methylene chloride, toluene, cyclohexane, butylacetate, and the like, with methylene chloride being preferred. Generally from about 1 milliliter to about 50 milliliters, and preferably from about 5 milliliters to about 15 milliliters of solvent are selected for each gram of dye to be dissolved therein. Dissolving of the dye is accomplished by simple stirring of the organic mixture comprised of solvent and dye. Subsequent to the evaporation of the solvent from the reaction mixture, the dye is retained in the polymer particles.

The dye solution can be added to the polymerized particles with stabilizer thereon in various suitable amounts providing the objectives of the present invention are achieved, however, the dye solution is usually added in an amount of from about 10 percent to about 500 percent by weight of the polymer particles. Upon the addition of the dye solution to the polymerized mixture an entropic dilution effect due to the initial absence of dye in the particles and the high polymer concentration causes the dye to diffuse through the solvent medium and into the polymer particles. The effectiveness and completion of this diffusion process is dependent on a number of factors including the concentration of the dye, solvent, and polymer particles, the specific types of dyes used, the nature of the particles being treated, and the temperature at which the process is accomplished.

For obtaining the final toner particles, the mixture of polymer and dye particles is subjected to further processing, inclusive of known spray drying or freeze drying methods permitting toner particles with a size diameter of from about 5 to about 20 microns. In one embodiment, spray drying is affected by forming a stirred suspension of polymer, dye particles and solvent medium. Subsequent to atomization, the resulting suspension can be dried at 120° C. in a drying chamber and collected in a product cyclone. Toner particles isolated in this matter can then be selected immediately for the purpose of developing latent electrostatic images present, for example, on a photoconductive imaging member.

Illustrative examples of carrier particles that can be selected for mixing with the colored toner particles of the present invention include those particles that are capable of triboelectrically obtaining a charge of opposite polarity to that of the toner particles. Accordingly, the carrier particles of the present invention can be selected so as to be of a negative polarity in order that the toner particles which are positively charged will adhere to and surround the carrier particles; or of a positive polarity in order that the toner particles which are negatively charged will adhere to and surround the carrier particles. Illustrative examples of carrier particles include methyl methacrylate, glass, steel, nickel, iron, ferrites, and the like. Additionally, there can be selected as carrier particles nickel berry carriers as disclosed in U.S. Pat. No. 3,847,604, which carriers are comprised of nodular carrier beads of nickel, characterized by surfaces of reoccurring recesses and protrusions thereby providing particles with a relatively large external area.

These carrier particles can be used with or without a coating, the coating generally being comprised of fluoropolymers, such as polyvinylidene-fluoride resins, terpolymers of styrene, methylmethacrylate, and a silane, such as triethoxy silane, tetrafluoroethylenes and other known coatings.

The diameter of the carrier particles is generally from about 50 microns to about 1,000 microns thus allowing these particles to possess sufficient density and insertia to avoid adherence to the electrostatic images during the development process. The carrier particles can be mixed with the toner particles in various suitable combinations, however, best results are obtained when about 1 part per toner to about 10 parts to about 200 parts by weight of carrier are selected.

The toner and developer compositions of the present invention may be selected for use in developing images in electrostatographic imaging processes wherein an image is generated on an inorganic photoreceptor, an organic photoreceptor, or layered photoreceptor members which are generally charged negatively, followed by development and transfer. Inorganic imaging members are selenium, selenium alloys, such as selenium arsenic, selenium tellurium, and the like; cadmium sulfide; halogen doped selenium substances; and halogen doped selenium alloys. Organic members include squaraine compounds, pyrillium dyes, polyvinylcarbazole 4-dimethylaminobenzlidene, benzhydrazide; 2-benzylidene-amino-carbazole, 4-dimethylamino-benzylidene, (2-nitro-benzylidene)-p-bromoaniline; 2,4-diphenylquinazoline; 1,2,4-triazine; 1,5-diphenyl-3-methyl pyrazoline 2-(4'dimethyl-amino phenyl)-benzoaxzole; 3-amino carbazole, polyvinyl carbazole-trinitrofluorenone charge transfer complex; and mixtures thereof.

Illustrative examples of layered photoresponsive members are comprised of transport layers and photogenerating layers, reference U.S. Pat. No. 4,265,990, the disclosure of which is totally incorporated herein by reference, and other similar layered photoresponsive devices. Examples of generating layers include trigonal selenium, metal phthalocyanines, metal free phthalocyanines and vanadyl phthalocyanines, while examples of charge transport layers include the diamines as disclosed in U.S. Pat. No. '990.

The following examples are being supplied to further define various species of the present invention, it being noted that these examples are intended to illustrate and not limit the scope of the present invention. Parts and percentages are by weight unless otherwise indicated.

EXAMPLE I

There were prepared polystyrene particles by dissolving 6 grams of the stabilizer poly-2-(vinyl pyridine) in 187.5 milliliters of methyl cellosolve, and 131.3 milliliters of ethanol at 68° C. with stirring under a nitrogen atmosphere. Subsequent to dissolution of the stabilizer there was added 57 milliliters of styrene monomer, and 2.25 grams of benzoyl peroxide. Within ten minutes the reaction mixture was clouded indicating the initiation of polymerization, and after 48 hours, there resulted subsequent to separation a product consisting of monodispersed polystyrene particles.

The product polystyrene particles with transformed poly(vinyl pyridine) stabilizer anchored thereto were removed from the solvent medium by centrifugation and dispersed in 500 milliliters of anhydrous ethanol. Thereafter, the resulting mixture was placed in a one liter 3-necked round bottom flask under nitrogen atmosphere with a water-cooled condenser. While stirring, 20 milliliters of cetyl bromide was added to the reaction mixture, followed by refluxing for 24 hours.

Subsequently, the reaction mixture was cooled to room temperature, and to this mixture was added a solution of 2.5 grams of Sudan Red 7B dye in 50 milliliters of methylene chloride. In addition, 20 milliliters of deionized water was added to enhance diffusion of the dye into the polymer particles. After stirring for 5 hours, the reaction mixture volume was reduced by half using a rotary evaporator, and then the toner particles were separated from the reaction medium by centrifugation. The toner particles were then dispersed in ethanol, the centrifugation and dispersion procedure repeated twice, and finally the toner particles were isolated form the ethanol with a rotary evaporator.

These toner particles, once the stabilizer had been transformed, had a triboelectric charge thereon as determined by the known Faraday Cage procedure thereon of 49.4 microcoulombs per gram against a carrier consisting of a steel core coated with a terpolymer of styrene methacrylate, and vinyltriethoxy silane, whereas identical toner untransformed particles had a triboelectric charge thereon of 39 microcoulombs per gram against the same carrier.

EXAMPLE II

The polymerization process of Example I was repeated with the exception that the steric stabilizer selected was poly(acrylic acid). The resulting polystyrene particles with poly(acrylic acid) stabilizer anchored thereto was removed from the solvent medium by centrifugation and dispersed in 500 milliliters of anhydrous ethanol, and 0.5 grams of p-toluene sulfonic acid. Thereafter, the aforementioned mixture was placed in a one liter 3-necked round bottom flask under a nitrogen atmosphere, and with a water-cooled condenser. Refluxing was accomplished for 24 hours, and the reaction mixture was permitted to cool to room temperature. After isolating the polymer particles from the solvent medium, the dyeing procedure of Example I was repeated, and the magenta colored polymer particles were separated from the dyeing mixture, dispersed in water followed by freeze drying thereof. There were obtained magenta toner particles with a triboelectric charge thereon of −4.3 microcoulombs per gram against a carrier consisting of a steel core coated with a terpolymer of styrene methacrylate, and vinyltriethoxy silane, whereas toner particles prepared in an identical manner with the exception that the stabilizer was not transformed had a triboelectric charge thereon of −13.3 microcoulombs per gram against the same carrier.

Other modifications of the present invention may occur to those skilled in the art based upon a reading of the present disclosure and these modifications are intended to be included within the scope of the present invention.

We claim:

1. An improved toner composition comprised of colored dyes and resin particles, having irreversibly anchored thereto a stabilizer generated by the reaction of a stabilizer selected from the group consisting of hydroxy celluloses, poly(acrylic acids), poly(vinyl butyral), and poly(vinyl pyridines), with an alkyl halide, an alcohol, or a carboxylic acid.

2. An improved composition in accordance with claim 1 wherein the stabilizers containing tertiary amines are reacted with alkyl halides.

3. An improved composition in accordance with claim 2 wherein the alkyl halide is cetyl chloride.

4. An improved composition in accordance with claim 1 wherein the poly(acrylic acid) stabilizers are reacted with alcohols.

5. An improved composition in accordance with claim 4 wherein the alcohol is methanol.

6. An improved composition in accordance with claim 4 wherein the alcohol is ethanol.

7. An improved composition in accordance with claim 1 wherein the hydroxy cellulose stabilizers are reacted with carboxylic acids.

8. An improved composition in accordance with claim 7 wherein the stabilizer is reacted with acetic acid.

9. An improved composition in accordance with claim 1 wherein the resin particles are comprised of styrene polymers.

10. An improved composition in accordance with claim 9 wherein the resin particles are comprised of styrene methacrylate, styrene acrylate, or styrene butadienes.

11. An improved toner composition in accordance with claim 1 wherein the colored dyes are selected form the group consisting of red, blue, yellow, cyan, and magenta.

12. An improved toner composition in accordance with claim 1 wherein the stabilizer particles are present in an amount of from about 0.1 percent by weight to about 1 percent by weight.

13. A method of developing images in an electrostatic imaging apparatus comprising causing the formation of an electrostatic image on an imaging member, followed by development of the image with the toner composition of claim 1, thereafter transferring the image to a suitable substrate and affixing the image thereon.

14. An imaging method in accordance with claim 13 wherein the resin particles are comprised of styrene polymers.

15. An imaging method in accordance with claim 14 wherein the resin particles are comprised of styrene methacrylate, styrene acrylate, or styrene butadienes.

16. An imaging method in accordance with claim 13 wherein the colored dyes are selected from a group consisting of red, blue, green, cyan and magenta substances.

17. An imaging method in accordance with claim 16 wherein the colored dyes are present in an amount of from about 0.1 percent by weight to about 1 percent by weight.

18. An improved toner composition in accordance with claim 1 wherein the triboelectric charge on the resulting toner composition having irreversibly anchored thereto the transformed stabilizers is from a positive or negative 5.0 microcoulombs per gram to a positive or negative 50 microcoulombs per gram.

19. A developer composition comprised of the toner composition of claim 1 and carrier particles.

20. A developer composition in accordance with claim 19 wherein the carrier particles are comprised of steel.

21. An improved toner composition consisting essentially of colored dyes and resin particles having irreversibly anchored thereto a component generated by the reaction of a compound selected from the group consisting of hydroxy celluloses, and poly(acrylic acid), poly(vinyl butyral), and poly(vinyl pyridines); with an alkyl halide, an alcohol, or a carboxylic acid.

22. An improved toner composition in accordance with claim 21 wherein the components is a steric stabilizer.

23. An improved toner composition in accordance with claim 21 wherein there results a positively charged toner composition.

24. An improved toner composition in accordance with claim 21 wherein there results a negatively charged toner composition.

25. A developer composition comprised of the toner composition of claim 21 and carrier particles.

26. A developer composition in accordance with claim 25 wherein the toner composition is negatively charged.

27. A developer composition in accordance with claim 25 wherein the toner composition is positively charged.

28. A developer composition in accordance with claim 25 wherein the carrier particles are comprised of steel.

* * * * *